US008567293B2

(12) United States Patent
Freudenberg et al.

(10) Patent No.: US 8,567,293 B2
(45) Date of Patent: Oct. 29, 2013

(54) METHOD FOR CUTTING THROUGH A BAND ENCOMPASSING A STACK OF BLANKS

(75) Inventors: Harald Freudenberg, Marklohe (DE); Otto Gerotzke, Reken (DE)

(73) Assignee: Focke & Co. (GmbH) & Co. KG), Verden (DE)

( * ) Notice: Subject to any disclaimer, the term of this patent is extended or adjusted under 35 U.S.C. 154(b) by 397 days.

(21) Appl. No.: 13/000,218

(22) PCT Filed: May 29, 2009

(86) PCT No.: PCT/EP2009/003839

§ 371 (c)(1),
(2), (4) Date: Dec. 20, 2010

(87) PCT Pub. No.: WO2010/003483

PCT Pub. Date: Jan. 14, 2010

(65) Prior Publication Data

US 2011/0100175 A1 May 5, 2011

(30) Foreign Application Priority Data

Jul. 10, 2008 (DE) ..... 10 2008 032 368

(51) Int. Cl.
*B65B 69/00* (2006.01)

(52) U.S. Cl.
USPC ..... 83/19; 53/382.1; 83/17; 83/27; 83/56

(58) Field of Classification Search
USPC ..... 53/382.1, 381.25; 83/19, 17, 23, 27, 56, 83/176, 375
See application file for complete search history.

(56) References Cited

U.S. PATENT DOCUMENTS 4,328,609 A * 5/1982 Born ..... 29/564.3
4,835,836 A * 6/1989 van Uitert ..... 29/564.3
4,929,141 A * 5/1990 Keesey et al. ..... 414/412

(Continued)

FOREIGN PATENT DOCUMENTS

DE 69000287 1/1993
DE 68906281 10/1993

(Continued)

OTHER PUBLICATIONS

Translation of Office Action from the State Intellectual Property Office of the People's Republic of China dated Feb. 28, 2012.

(Continued)

*Primary Examiner* — Essama Omgba
*Assistant Examiner* — Jason L Vaughan
(74) *Attorney, Agent, or Firm* — Laurence P. Colton; Smith Risley Tempel Santos LLC

(57) ABSTRACT

A method of severing a band (11) which encloses a blank stack (10), wherein the band (11), preferably in the region of a band station (19), is severed by a cutting means, in particular a knife (23), and is then removed from the blank stack (10). According to the invention, it is provided that the blank stack (10) is pushed together such that the band (11) is spaced apart from the blank stack (10), at least in certain regions, and that the band (11) is then severed in the spaced-apart region by the cutting means. The invention also relates to a corresponding apparatus for implementing the method.

7 Claims, 3 Drawing Sheets

(56) References Cited

U.S. PATENT DOCUMENTS

| | | | | | |
|---|---|---|---|---|---|
| 5,101,703 | A | * | 4/1992 | Tanaka et al. | 83/880 |
| 5,156,516 | A | * | 10/1992 | Boisseau | 414/412 |
| 5,318,399 | A | * | 6/1994 | Marom | 414/412 |
| 5,423,649 | A | * | 6/1995 | Maeda et al. | 414/412 |
| 5,533,854 | A | * | 7/1996 | Focke et al. | 414/412 |
| 5,680,691 | A | * | 10/1997 | Marom et al. | 29/564.3 |
| 5,727,747 | A | * | 3/1998 | Hannen et al. | 242/527 |
| 5,758,362 | A | | 6/1998 | Focke | |
| 5,901,626 | A | * | 5/1999 | Temburg | 83/364 |
| 7,963,086 | B2 | * | 6/2011 | Porter et al. | 53/381.2 |
| 2004/0244206 | A1 | | 12/2004 | Perlmutter et al. | |

FOREIGN PATENT DOCUMENTS

| | | | |
|---|---|---|---|
| DE | 68919977 | | 5/1995 |
| DE | 19607541 | | 7/1997 |
| DE | 3943745 | | 10/1997 |
| DE | 20008174 | | 9/2001 |
| DE | 20008174 | U1 | 9/2001 |
| DE | 69900829 | | 10/2002 |
| DE | 69900923 | | 10/2002 |
| DE | 102004007488 | | 9/2005 |
| EP | 0706946 | | 4/1996 |
| JP | 01254532 | A | 10/1989 |
| JP | 8175527 | A | 7/1996 |
| JP | 11180423 | A | 7/1999 |

OTHER PUBLICATIONS

Japanese Patent Office, Official Action (English Translation) on related Japanese Patent Application No. 2011-516985, (Oct. 30, 2012).

* cited by examiner

METHOD FOR CUTTING THROUGH A BAND ENCOMPASSING A STACK OF BLANKS

BACKGROUND OF THE INVENTION

1. Technical Field

The invention relates to a method of severing a band which encloses a blank stack, wherein the band, preferably in the region of a band station, is severed by a cutting means, in particular a knife, and is then removed from the blank stack. The invention also relates to a corresponding apparatus, in particular for implementing the aforementioned method, for severing a band which encloses a blank stack, having a band station in which the blank stack rests on its underside on an underlying surface, in particular a platform, and in which the band can be severed by a cutting means, in particular a knife.

2. Prior Art

Blanks for producing packs made of (thin) cardboard, in particular for producing hinge-lid boxes (hinge-lid packs) for cigarettes, are prefabricated, usually in a cardboard-box factory and supplied as a blank stack. In order to safeguard the formation of the blank stack, it is often common practice to provide the blank stack with a strip-like enclosing band made of paper, foil or the like. In the region of the packaging machine, the band then has to be severed and disposed of, in order for it to be possible for the band-free blank stack to be transferred to the packaging machine, in particular to a blank magazine of the same, for further processing.

A method and an apparatus of the type mentioned in the introduction are known, for example, from the applicant's EP 0 706 946 B1 and have proven successful, in principle, in practice.

BRIEF SUMMARY OF THE INVENTION

Proceeding herefrom, it is an object of the invention to develop the method and apparatus of the type mentioned in the introduction further, in particular in respect of making it possible for the bands to be opened in a manner which safeguards the blanks to a greater (or even greater) extent.

This object is achieved by a method of severing a band which encloses a blank stack, wherein the band, preferably in the region of a band station, is severed by a cutting means, in particular a knife, and is then removed from the blank stack, characterized in that the blank stack is pushed together such that the band is spaced apart from the blank stack, at least in certain regions, and in that the band is then severed in the spaced-apart region by the cutting means.

Accordingly, it is provided that the blank stack is pushed together such that the band is spaced apart from the blank stack, at least in certain regions, and that the band is then severed in the spaced-apart region by the cutting means. In contrast to EP 0 706 946 B1, the blank stack is thus not pushed together in order to spread apart the blanks in the stack so that a knife can penetrate into the blank stack and sever the band (column 4, lines 22 to 42); rather, the entire blank stack is pushed together so that the band is exposed and can be severed to the side of the blank stack. This makes it possible to avoid any possible damage to the blanks by contact with the cutting means as the band is being severed.

In a preferred configuration of the method according to the invention, it is provided that the band, at least during the operation of the blank stack being pushed together, is retained in certain regions and/or is brought into abutment against at least one side surface of the blank stack such that the band, by virtue of the blank stack being pushed together, is spaced apart from the blank stack in a non-retained region, or in a region which does not butt against the at least one side surface of the blank stack, and is severed there by way of the cutting means. The term "retained" should be understood to the effect that the position of the band is changed only insignificantly, if at all, in this region by virtue of the blank stack being pushed together and thus compressed in the process. This then results in the band being spaced apart in the other regions.

This can preferably take place such that the blank stack, during the pushing-together operation, butts partially, in the region of a side surface, against an abutment wall, wherein the abutment wall has smaller dimensions, in particular a lower height, than the corresponding side surface of the blank stack such that the band, by virtue of the blank stack being pushed together, is spaced apart from the blank stack in that region of the side surface of the latter that does not butt against the abutment wall, and is severed there by way of the cutting means. This makes it possible to create the position of the spaced-apart region in a specific manner so that the knife can be moved always in a predetermined, constant cutting plane.

According to a preferred development, it is provided that the abutment wall, preferably as the blank stack is being pushed together, is moved by the ram plate into a correct position relative to a side surface, in particular the upper side, of the blank stack such that the abutment wall, irrespective of the dimensioning, in particular height, of the blank stack in each case, does not cover a preferably essentially constant-height portion of the side wall of the blank stack. This means that the band, irrespective of the height of the blank stack, can be spaced apart from the blank stack at a suitable location in order to ensure that the severing cut is always carried out correctly.

The pressure is applied to the blank stack preferably in that the blank stack in the band station rests on an underlying surface, in particular a platform, and the band is spaced apart from the blank stack by virtue of pressure being applied, in particular by means of a ram plate, to a side surface, in particular an underside and/or upper side, of this blank stack. It should be emphasized that preferably the entire blank stack is compressed, for example by virtue of being pushed together in the vertical direction.

The direction in which the pressure is applied to the stack can depend, in the first instance, on the dimensions of the blanks and, in addition, on whether the stack is in a standing or lying position. In the preferred exemplary embodiment, the stack stands upright and the blanks are located in a flat (horizontally oriented) state one above the other within the stack, so that the pressure is directed transversely to the upper side and/or underside of the blanks. Correspondingly, it is possible, in the case of a stack in a lying position in which the blanks stand upright one beside the other, for the pressure to be applied laterally to the stack, that is to say, once again, transversely to the vertically oriented large-surface-area upper sides and/or undersides of the blanks.

It is further conceivable for the pressure to be applied essentially parallel to the upper side and/or underside of the blank. This gives rise to the blanks being deformed in a curved manner, as a result of which the band is spaced apart from the stack, and can be severed, at one end of the stack. It is conceivable, for example in the case of a stack in a standing position according to the exemplary embodiment, for lateral pressure to be applied to the blanks such that the latter curve upward approximately in the longitudinal center, so that the severing cut can be carried out in the region of the underside of the blank stack.

The operation of severing the band in the region spaced apart from the blank stack is preferably carried out at a (lateral) distance from the blank stack, or the contour of the blank stack, such that the cutting means does not penetrate into the blank stack to prevent the blanks from being damaged by the cutting means.

The severed band is removed from the blank stack preferably in that in the first instance a crosspiece of the band is pulled off from the blank stack in the region of a side surface, in particular of the upper side, in particular by being raised, preferably by means of a suction mechanism, and in that thereafter the blank stack is conveyed away out of the band station, wherein the band is pulled off from the blank stack in particular by a pulling mechanism.

Further advantageous configurations of the method according to the invention can also be gathered from the dependent claims and the description.

An apparatus which achieves the object mentioned in the introduction is an apparatus for severing a band which encloses a blank stack, having a band station in which the blank stack rests on its underside on an underlying surface, in particular a platform, and in which the band can be severed by a cutting means, in particular a knife, characterized in that the blank stack, for the purpose of spacing the band apart from the blank stack at least in certain regions, can be pushed together, in particular by means of a ram plate, such that the band can be severed in the spaced-apart region by way of the cutting means.

Accordingly, it is provided that the blank stack, for the purpose of spacing the band apart from the blank stack at least in certain regions, can be pushed together, in particular by means of a ram plate, such that the band can be severed in the spaced-apart region by way of the cutting means. This gives rise to the advantages mentioned in the introduction.

Preferred developments in respect of the adjustment of an abutment wall can be gathered from the dependent claims.

A special feature, furthermore, may be constituted by the fact that the knife is oriented in a plane which is directed obliquely in relation to the side surfaces of the blank stack and of the band, and that a cutting edge of the knife is directed away from the blank stack such that, as the band is being severed, a tensile force which is directed away from the blank stack can be applied to the band. This means that the band is held taut as the severing cut is being carried out.

Further advantageous configurations of the apparatus according to the invention can also be gathered from the dependent claims and the description.

BRIEF DESCRIPTION OF THE FIGURES

A preferred exemplary embodiment of the invention will be explained hereinbelow with reference to the drawing, in which.

DETAILED DESCRIPTION OF PREFERRED EMBODIMENTS

Figure 2:
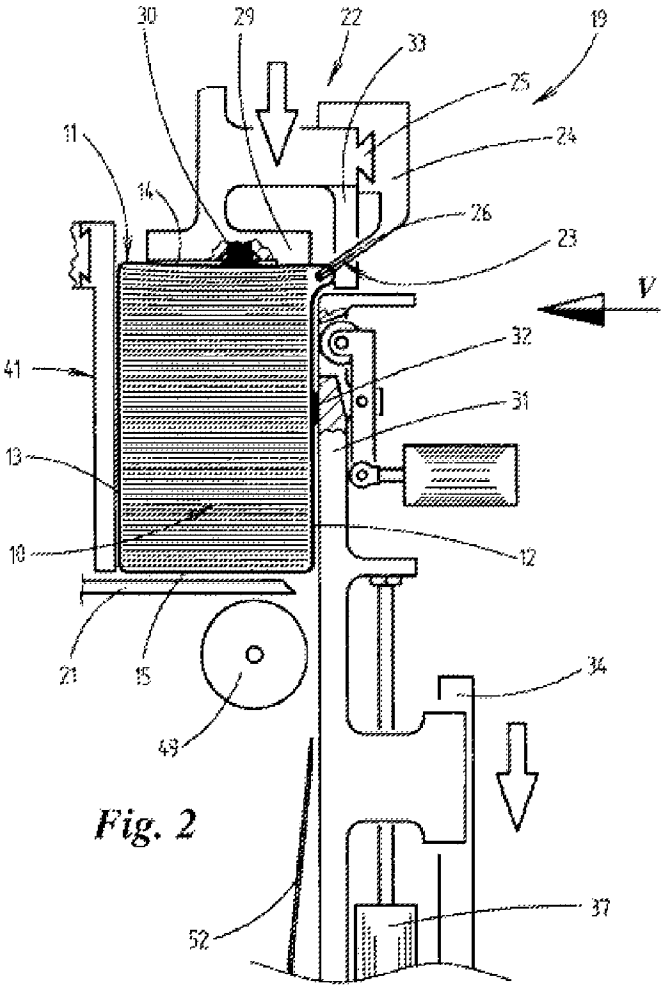
FIG. 2 shows the apparatus according to FIG. 1 as the band is being severed.

The exemplary embodiments in the drawings concern the handling of stacks 10 of blanks for the cigarette industry, these blanks being elongate ones with the contour which is typical of those for the production of hinge-lid boxes (hinge-lid packs). The blanks consist of thin cardboard. Within the blank stack 10, the blanks are located in a flat state one above the other, wherein side peripheries of the blanks are oriented such that the blank stack 10 has linear side peripheries.

Each blank stack 10 is enclosed by a strip-like band 11. The latter is designed as a finite, rectangular tubular piece with mutually opposite upright legs 12, 13 and upper and lower crosspieces 14, 15. The band 11 is formed from a finite material strip with an adhesively bonded overlap in the region of the leg 13. The band 11 consists preferably of paper, but may also consist of a foil or some other suitable material.

The blank stacks 10 provided with such a band 11 are supplied, for example, on a pallet (not shown). A suitable lifting conveyor, e.g. a robot with a lifting head, sets the blank stacks 10 down individually or in groups, to form a continuous row, on a feed conveyor. The latter may be designed as a belt conveyor in accordance with EP 0 706 946 B1. The feed conveyor can convey the blank stacks 10 one after the other into a band station 19. In the region of the latter, the band 11 is severed and disposed of. The blank stacks 10 which have been freed of the band 11 are then transferred to a removal conveyor, which feeds the blank stacks 10 for further processing. The band station 19 may be, for example, part of a packaging machine for producing hinge-lid boxes for cigarettes. As in the case of EP 0 706 946 B1, the feed conveyor and band station 19 may be positioned in the region of the rear side of the packaging machine.

In the band station 19, the blank stack 10 is conveyed by the feed conveyor onto an underlying surface, namely onto a platform 21. The blank stack 10 rests on the latter during the operation of the band 11 being severed.

Figure 5:
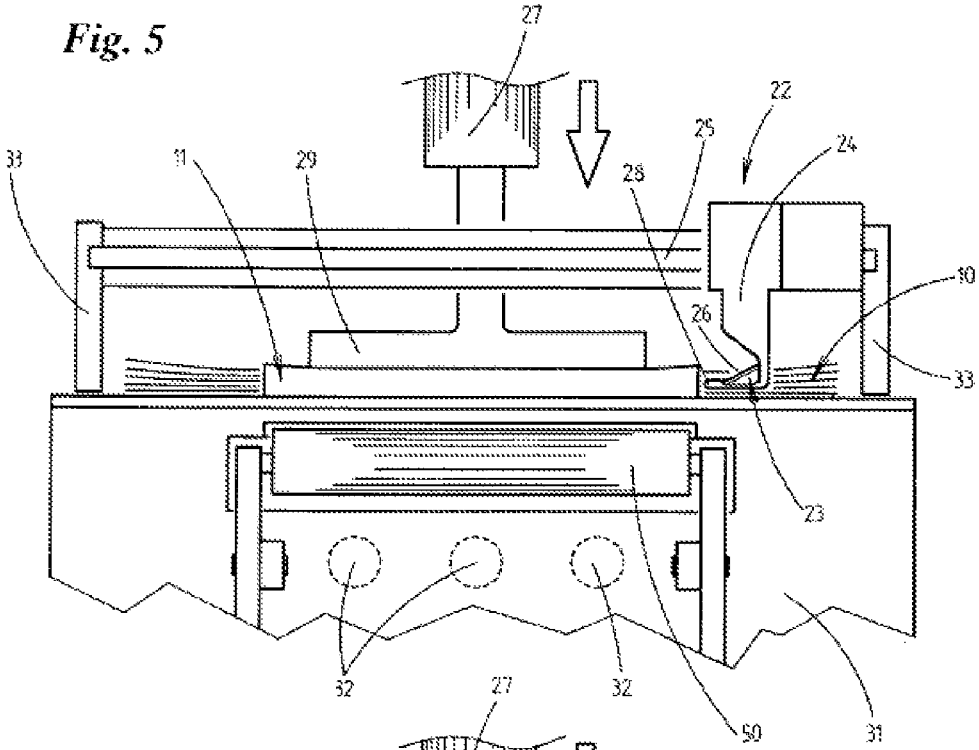
FIGS. 5 and 6 show a side view of the apparatus as seen in arrow direction V in FIG. 2 at different points in time during the operation of severing the band.
Figure 6:
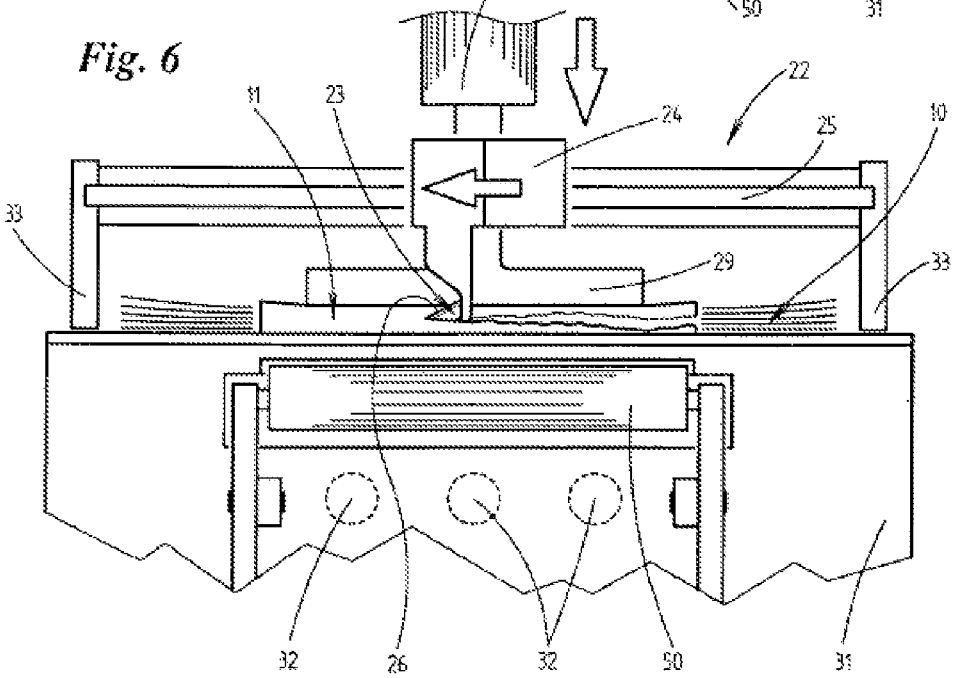

A cutting arrangement 22 which can be moved up and down is positioned above the platform 21 and/or the blank stack 10. This cutting arrangement is provided with a knife 23 as the cutting means for severing the band 11. For this purpose, the blade-like knife 23 is moved in a horizontal plane relative to the blank stack 10 and/or to the band 11 (FIGS. 5 and 6).

For this purpose, the knife 23 is fitted on a knife holder 24, which can be moved back and forth and can be displaced in the manner of a carriage on a guide rail 25 of the cutting arrangement 22. The elongate knife 23, or a cutting edge 26 of the same, is directed away obliquely from the blank stack 10, so that the band 11 is automatically held taut as the severing cut is being carried out.

In order for the severing cut to be carried out, the knife holder 24 is displaced along the guide rail 25. The knife 23 here is guided laterally alongside the blanks, in the first instance outside the region of the band 11, until the upright leg 12 is gripped and severed. This operation is assisted by a guide pin 28, which is formed in front of the cutting edge 26 of the knife 23 (FIG. 5). During the cutting movement, the knife 23 slides to the end of the blank stack 10.

In order for a cutting operation to be carried out, the cutting arrangement 22 can be lowered into the cutting plane by a lifting cylinder 27. Prior to the band 11 being severed, pressure is applied to the blank stack 10 from above by an elongate, strip-like ram plate 29. The latter is lowered onto the blank stack 10 from above, along with the cutting arrangement 22, and is subjected to the action of the lifting cylinder. Together with the cutting arrangement 22, furthermore, a suction mechanism 30 is lowered onto the blank stack 10 from above, this mechanism, in the present case, being arranged in the region of the underside of the ram plate 29 and serving for gripping the crosspiece 14 of the band 11.

The blank stack 10 is subjected to pressure by the ram plate 29 such that the entire blank stack 10 is pushed together, which means that the band 11, rather than continuing to enclose the blank stack 10 tightly, is loosened. This then gives rise to the formation of in particular loop-like regions in which the band 11 is spaced apart from the blank stack 10, that is to say runs at a distance from the contour of the blank stack 10. This is exploited in order for the severing cut to be carried out in these regions. It is possible here for the knife 23, or the cutting edge 26, to be guided laterally alongside the blank stack 10, so that there is no risk of the blank stack 10 being damaged by the knife 23.

Figure 1:
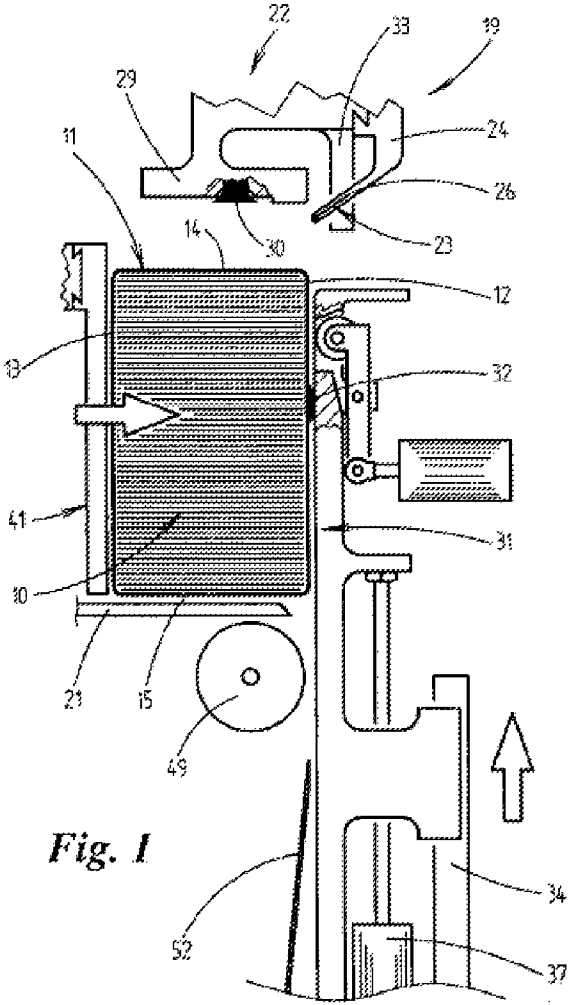
FIG. 1 shows a side view of an apparatus for removing bands.

Once the severing cut has been carried out, the knife 23 is moved back, by way of the knife holder 24, into the starting position and the cutting arrangement 22 is moved into the upper, starting position according to FIG. 1. The severed band 11 is then disposed of. For this purpose, the band 11 is gripped in the region of the leg 12 by a holder. The latter, in the present case, is assigned to an abutment wall 31 which, in the starting position, serves at the same time for positioning the blank stack 10 precisely on the platform 21. The blank stack 10 butts against the abutment wall 31 by way of the leg 12 of the band 11 (FIG. 1).

However, rather than being used just for removing the band 11 and for positioning the blank stack 10, the abutment wall 31 also assists in carrying out the severing cut. As is evident from FIG. 1, the abutment wall 31 terminates at a distance beneath the upper side of the blank stack 10. Since the blank stack 10 butts against the abutment wall 31 by way of the leg 12, the band 11 can form a loop only in the region above the abutment wall 31, since the ram plate 29 also extends approximately into the plane of the abutment wall 31. This means that the arrangement of the abutment wall 31 predetermines the region in which the band 11 is spaced apart from the blank stack 10. As a result, the severing cut can be carried out always in the same plane.

A further special feature is constituted by the fact that the position of the abutment wall 31 can be adapted to the height of the blank stack 10. For this purpose, the abutment wall 31 is moved in the first instance into an upper position according to FIG. 1. In this position, the abutment wall 31, depending on the height of the blank stack 10, can also project beyond the latter. As the cutting arrangement 22 is lowered, the position of the abutment wall 31 is then adapted in a vertical direction. A pusher 33 is provided for this purpose, this pusher being fixed on the cutting arrangement 22 and projecting in relation to the underside of the ram plate 29. The pusher 33 is positioned such that, as the cutting arrangement 22 is being lowered, it moves the abutment wall 31 downward in the vertical direction. In the present exemplary embodiment, this is achieved in that the pusher 33, as the cutting arrangement 22 is being lowered, pushes against the upper side of the abutment wall 31 and moves the latter correspondingly downward. This results in the upper periphery of the abutment wall 31 being spaced apart from the plane of the underside of the ram plate 29 to a defined extent corresponding to the extent by which the pusher 33 projects in relation to the underside of the ram plate 29, irrespective of the height of the blank stack 10.

The lower end position of the abutment wall 31 and of the ram plate 29 is predetermined, in the present case, by the blank stack 10. As soon as it is no longer possible for the latter to be pushed together any further, the lifting cylinder is switched off and the severing cut is carried out. This makes it possible for blank stacks 10 of different heights to be processed in the apparatus.

The abutment wall 31, furthermore, is provided with retaining mechanisms for gripping the band 11 following the severing operation. These retaining mechanisms are in the form of a plurality of suction mechanisms 32 arranged one beside the other. These are positioned on the abutment wall 31 such that they grip the severed leg 12 in the upper region. For this purpose, the abutment wall 31 may be mounted by way of sliding guides, in a manner analogous to EP 0 706 946 B1, on two spaced-apart, upright guide rods 34. The abutment wall 31 can be moved up and down by a linear cylinder 37.

Figure 4:
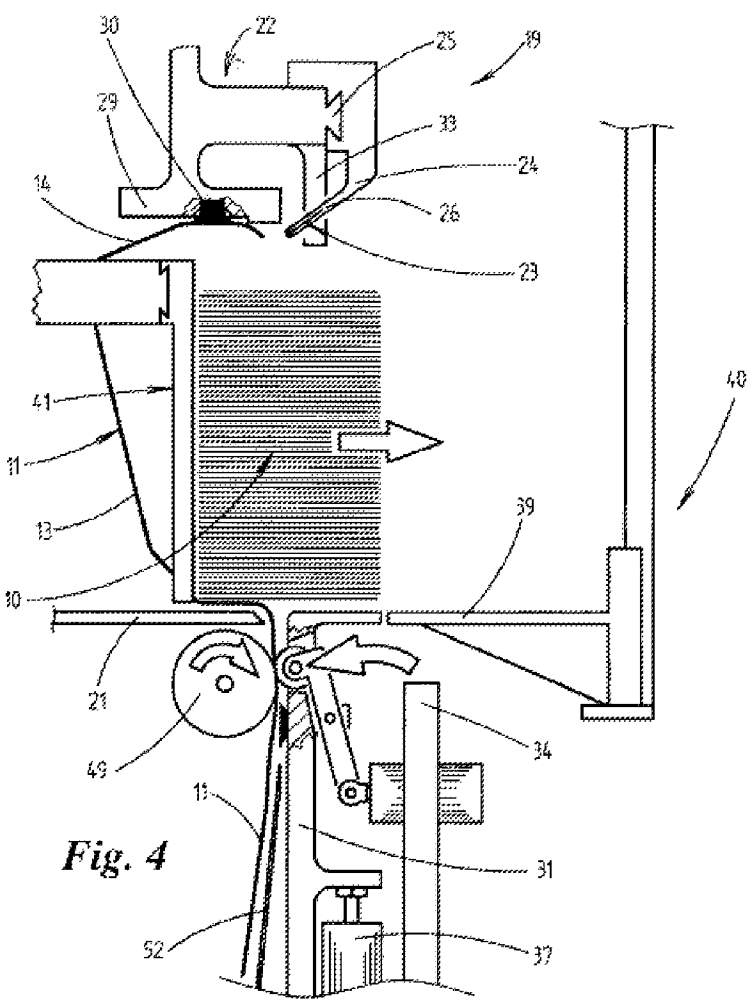
FIG. 4 shows the apparatus according to FIG. 1 as the blank stack is being pushed off.
Figure 3:
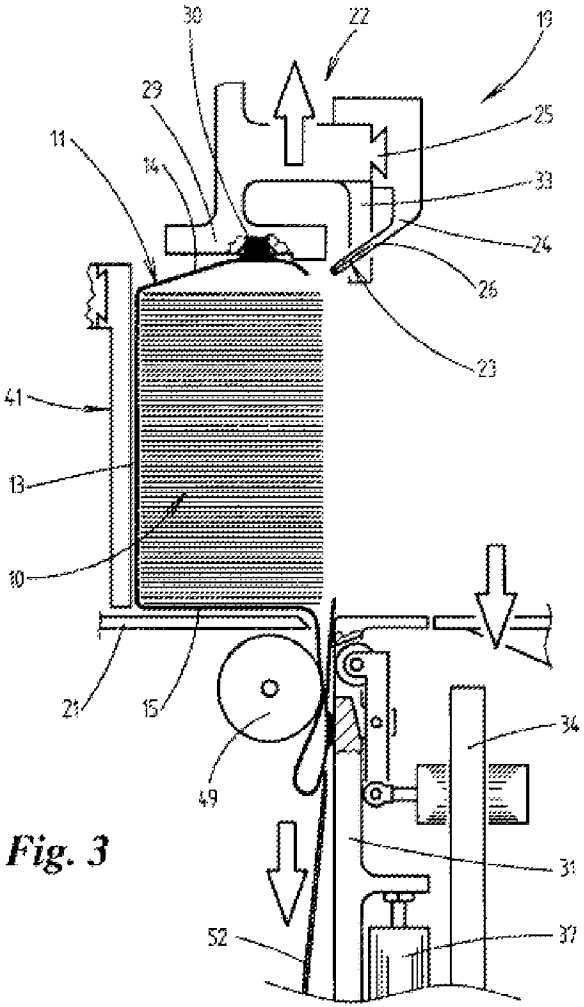
FIG. 3 shows the apparatus according to FIG. 1 as the band is being pulled off.

By virtue of the abutment wall 31 being moved downward out of the upper position according to FIGS. 1 and 2 into the lower position according to FIGS. 3 and 4, the leg 12 of the band 11, this leg being retained by the suction mechanisms 32, is moved downward as well. Since the blank stack 10 rests on the remainder of the band 11, namely on the lower crosspiece 15, without undergoing any changes, the leg 12 in the first instance forms a loop (FIG. 3).

The blank stack 10 is then moved out of the band station 19 (FIG. 4), wherein the severed band 11 is held back and conveyed away. The blank stack 10 passes, without its band 11, onto a removal conveyor. In the present case, the blank stack 10 is pushed out of the platform 21 directly onto a platform 39 of a vertical conveyor 40. The platform which has one side mounted on this vertical conveyor 40 extends level with the platform 21 as it receives the blank stack 10. The blank stack 10 is transferred from the platform 21 onto the vertical conveyor 40 by a pusher unit 41, which may be designed in accordance with EP 0 706 946 B1.

Further pulling mechanisms take effect in order to remove the severed band 11 altogether in the downward direction, these pulling mechanisms being formed by a pair of pulling rollers comprising a first, fixed-location pulling roller 49 and a second, pivotable abutment roller 50. The latter is arranged in a pivotable manner on the abutment wall 31, above the suction mechanisms 32. The band 11, or the leg 12 thereof, butts against the pulling roller 49 following the severing operation. By virtue of being pivoted into the position according to FIG. 4, the abutment roller 50 moves against the pulling roller 49. The abutment roller 50 here passes through a through-passage in the abutment wall 31. The pair of rollers 49/50 then act together to convey the entire band 11 in the downward direction. It is preferably provided that the pulling roller 49 and the abutment roller 50 are driven in rotation exclusively during the period of time which is shown in FIG. 4, and are at a standstill for the rest of the time. The band 11, which finally is pulled all the way off from the blank stack 10, passes, via a directing plate 52, into a collecting container (not shown) beneath the platform 21.

LIST OF DESIGNATIONS

10 Blank stack
11 Band
12 Leg
13 Leg
14 Crosspiece
15 Crosspiece
19 Band station
21 Platform
22 Cutting arrangement
23 Knife
24 Knife holder
25 Guide rail
26 Cutting edge
27 Lifting cylinder
28 Guide pin
29 Ram plate
30 Suction mechanism

31 Abutment wall
32 Suction mechanism
33 Pusher
34 Guide rod
37 Linear cylinder
39 Platform
40 Vertical conveyor
41 Pusher unit
49 Pulling roller
50 Abutment roller
52 Directing plate

The invention claimed is:

1. A method of severing a band (11) which encloses a blank stack (10), comprising:

a) pushing together the blank stack (10) such that the band (11) is spaced apart from the blank stack (10), at least in a certain spaced-apart region, wherein, while the blank stack (10) is being pushed together, the band is retained in certain regions and/or is brought into abutment against at least one side surface of the blank stack (10), wherein, while the blank stack (10) is being pushed together, the blank stack (10) butts partially, in the region of the at least one side surface of the blank stack (10), against an abutment wall (31), wherein the abutment wall (31) has a lower height than the corresponding at least one side surface of the blank stack (10), wherein, by virtue of the blank stack (10) being pushed together, the band (11) is spaced apart from the blank stack (10) in a non-retained region or in a region which does not butt against the at least one side surface of the blank stack (10), and is spaced apart from the blank stack (10) in a region of the at least one side surface of the blank stack (10) that does not butt against the abutment wall (31), and wherein, while the blank stack (10) is being pushed together, the abutment wall (31) is moved by a ram plate (29) into a correct position relative to a region of action of a cutting means such that the abutment wall (31), irrespective of the height of the blank stack (10) in each case, does not cover an essentially constant-magnitude portion of the at least one side wall of the blank stack (10);

b) severing the band (11) in the spaced-apart region, which also is in the region of a band station (19), by the cutting means, knife (23); and then c) removing the band (11) from the blank stack (10).

2. The method as claimed in claim 1, wherein the blank stack (10) in the band station (19) rests on an underlying surface platform (21), and the band (11) is spaced apart from the blank stack (10) by virtue of pressure being applied by means of a ram plate (29), to an upper side surface, of the blank stack.

3. The method as claimed in claim 2, wherein the blank stack (10) rests on the platform (21) and the ram plate (29) is used to apply pressure to a large-surface-area underside of the blank stack and the upper side surface of the blank stack, in order to space apart the band.

4. The method as claimed in claim 2, further comprising transporting the blank stack (10) enclosed by the band (11), in the band station (19), onto a platform (21), moving the abutment wall (31) upward in the vertical direction, bringing the blank stack (10) into abutment against the abutment wall (31) by way of the at least one side surface, which is forward oriented as seen in the transporting direction, and then, moving the ram plate (29) vertically against the upper side surface of the blank stack (10), while in the process the blank stack (10) is compressed and the abutment wall (31) is carried along by a pusher (33) which is coupled to the ram plate (29), wherein, by virtue of the blank stack (10) being compressed, the band (11) is spaced apart from the blank stack (10) outside the abutment wall (31), and therefore the knife (23) is moved along the band (11) in this region, in order to sever the band (11), without the knife (23) penetrating into the blank stack (10), the band (11) being pulled off from the blank stack (10) thereafter.

5. The method as claimed in claim 2, wherein the blank stack (10) rests on the platform (21) and the ram plate (29) is used to apply pressure to a large-surface-area underside of the blank stack, in order to space apart the band.

6. The method as claimed in claim 1, wherein the operation of severing the band (11) in the spaced apart region is carried out at a lateral distance from the blank stack (10), or from a contour of the blank stack (10), such that the cutting means does not penetrate into the blank stack (10) during the operation of severing the band (11).

7. The method as claimed in claim 1, wherein the band (11), following the severing operation, is removed from the blank stack (10) by first pulling off a crosspiece (14) of the band (11) from the blank stack (10) in the region of an upper side of the blank stack (10) by being raised by means of a suction mechanism (32), and second conveying the blank stack (10) away out of the band station (19), wherein the band (11) is pulled off from the blank stack (10) by a pulling mechanism (49, 50).

* * * * *